US006086213A

United States Patent [19]

Holce

[11] Patent Number: 6,086,213

[45] Date of Patent: Jul. 11, 2000

[54] UNIVERSAL MOUNT FOR EL LIGHTS, RETROREFLECTIVE SHEETING MATERIALS, AND REFLECTORS

[76] Inventor: Mary Elizabeth Holce, Rte. 1 Box 184-B Beet Rd., Walla Walla, Wash. 99362

[21] Appl. No.: 09/095,315

[22] Filed: Jun. 10, 1998

[51] Int. Cl.[7] ..... F21V 9/16

[52] U.S. Cl. ..... 362/84; 362/103; 362/108

[58] Field of Search ..... 362/84, 103, 108, 362/806

[56] References Cited

U.S. PATENT DOCUMENTS

| | | | |
|---|---|---|---|
| 5,475,574 | 12/1995 | Chien | 362/84 |
| 5,630,382 | 5/1997 | Barbera et al. | 362/108 |
| 5,676,451 | 10/1997 | Tabanera | 362/84 |
| 5,688,038 | 11/1997 | Chien | 362/84 |
| 5,779,348 | 7/1998 | Interlicchio | 362/103 |
| 5,836,671 | 11/1998 | Chien | 362/84 |

*Primary Examiner*—Thomas M. Sember

[57] ABSTRACT

The universal mount assembly device is comprised of a substantially flexible material having a top surface member, a back surface member, and an inside. The universal mount is detachably secured to an object, person, or animal. The top surface member has one or more dimensional and arranged openings or slots, or other securement means, to detachably affix one or more EL electro-luminescent lights. Upon the top surface member may also be affixed one or more rigid reflectors, or retroreflective or reflective sheeting material. Additionally, flexible straps, or other means, may be used to detachable secure the universal mount assembly device to an object, person, or animal. One or more dimensional and arranged openings or slots may be provided on the universal mount assembly device to facilitate a secure attachment for the straps, or other means, to the object, person, or animal. One or more sections of stretchable elastic material may optionally be attached to the universal mount assembly device to facilitate a snug fit of the universal mount assembly device to an object, person, or animal.

12 Claims, 5 Drawing Sheets

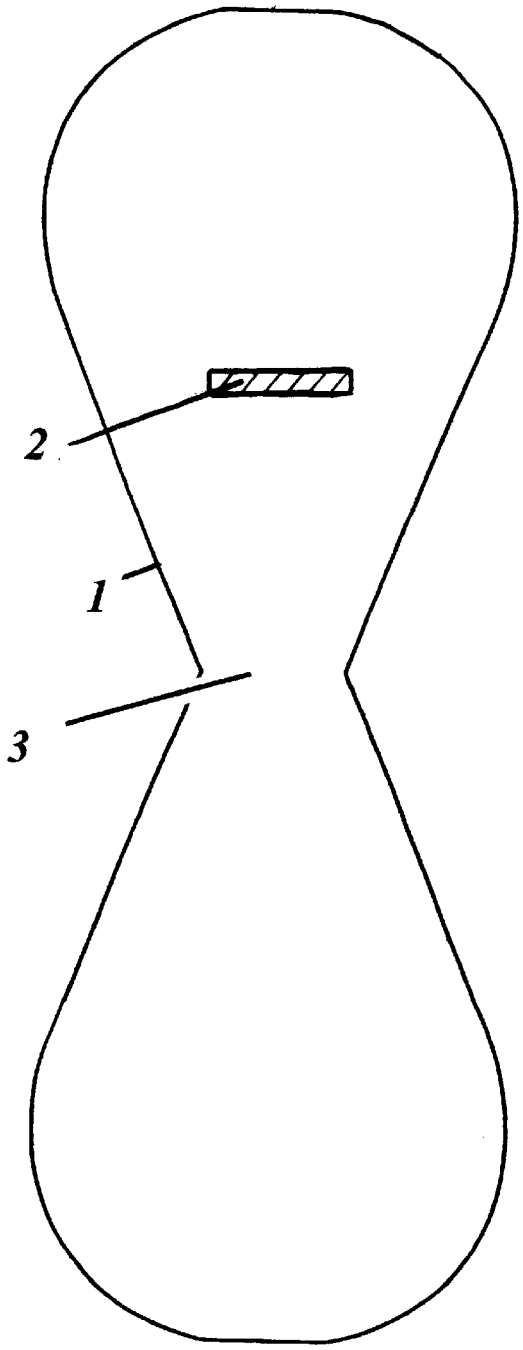
Fig.1
Fig. 2
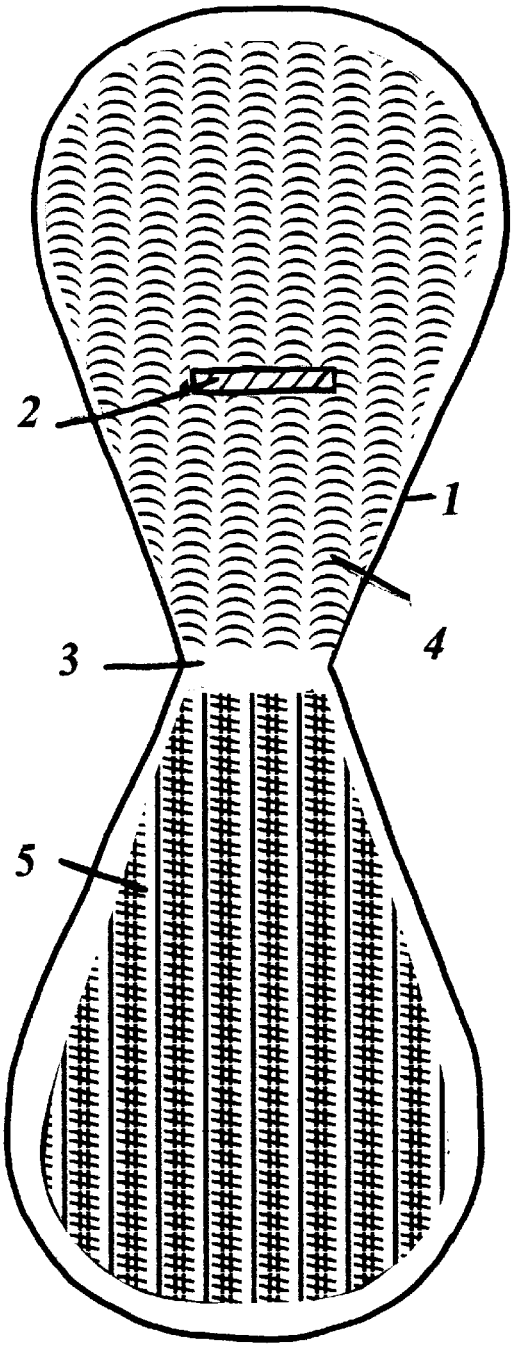

UNIVERSAL MOUNT FOR EL LIGHTS, RETROREFLECTIVE SHEETING MATERIALS, AND REFLECTORS

CROSS-REFERENCE TO RELATED APPLICATIONS

"Not applicable"

STATEMENT REGARDING FEDERALLY SPONSORED RESEARCH OR DEVELOPMENT

"Not Applicable"

REFERENCE TO A MICROFICHE APPENDIX

"Not Applicable"

BACKGROUND OF THE INVENTION

This invention relates generally to reflective and electrically controlled assemblies which may include a plurality of light emitting elements, and reflective elements, used for attachment to a person or object to provide enhanced visibility, safety, and recognition and appearance. This would include electro-luminescent lights (EL) lights, reflectors, retroreflective sheeting material and the like, and how they relate to the current invention.

The use of light illuminating devices and assemblies having light emitting elements and electro-luminescence, such as Light Emitting Diode (LED) modules, or (EL) electro-luminescent lights, or reflectors and retroreflective sheeting material used for illuminating a decoration or design applied, painted, or printed on wearing apparel, and other items, or accessories is known. For examples of prior patents relating to light illuminating devices and assemlies and to various ways to affix the LED modules and EL lights and reflectors and reflective material into an assembled position to accomplish the desired coaction with such decorations or designs, reference may be had to U.S. Pat. Nos. 5,440,461, 5,613,756, 5,426,792, 5,577,828, 3,950,076, 5,485,358, 5,570,945, 5,660,460, 5,688,038, 567,790. These devices or assemblies are related to, but are quite different from the current invention. For a discussion of the retroreflective sheeting material and it's manufacturing process, reference may be seen in U.S. Pat. No. 4,801,193.

In U.S. Pat. No. 3,950,076 a pair of discs that are safety reflectors are attached together by snaps that can be snapped on to a person's belt, or a bicycle spoke or other applications. As an improvement upon this previous invention the current invention provides additional means to facilitate the use of EL lights by providing one or more cut out slots upon the front surface member to accommodate the sleeve or hook in addition to other means to secure the EL lights(s) to it, and the use of retroreflective materials, and the use of VELCRO for the closure method facilitates changes from U.S. Pat. No. 3,950,076.

In U.S. pat. No. 4,038,552 the safety device claimed is also comprised of a pair of plates or reflectors having a hinge between them that can be hooked to a person, additionally by chain, but once again the current invention is different in the same way as previously discussed because there is no provision for the application of EL lights or the use or retroreflective materials. U.S. Pat. No. 4,038,552 references U.S. Pat. No. 3,950,076.

U.S. Pat. No. 5,677,790 comprises an article made of light-reflecting material which may be attached to a person or object by means or a clip which allows it to rotate. This is not the same as the current invention because the current invention does not rotate, as well as providing for the use of EL lights(s).

U.S. Pat. No. 5,485,358 is made up of several LED lights mounted on a flexible plate, which has been mounted on a hat and has lead wires running to the circuit board. This is not the same as the current invention because of the circuit board arrangement and also does not provide for the use of retroreflective materials or reflectors.

U.S. Pat. No. 5,440,461 permits the use of one or more light emitting elements without the need for predetermined openings in the fabric, and used a central bore for the light receiving element and a base flange portion adapted to contact the exterior surface of the apparel article. The light emitting elements penetrate the fabric and are pressed into engagement with an electrically conductive pattern formed or carried on the interior surface of the interposed section of fabric. This in not the same as the current invention because of the two piece enclosure for the light emitting element described does not resemble the current invention, and also does not provide for the use of retroreflective material or reflectors.

U.S. Pat. No. 5,660,460 describes a portable lighting system that is attachable to an article of clothing, but is not the same as the current invention because it has a plurality of battery sets with a power cord in connection between the battery pack and the light source, and does not resemble the current invention because it also does not provide for the use of retroreflective material or reflectors.

U.S. Pat. No. 5,613,756 is a clothing article with an illuminating device comprising an illuminating panel, a power source connected to the illuminating panel, a sleeve for protecting the illuminating panel, and is detachable, a window opening provided on the pouch for permitting light to pas through. The current invention does not claim to be clothing, and provides for the use of retroreflective material and reflectors.

In U.S. Pat. No. 5,428,488 an article of apparel includes the use of LED lights and a digital pulser comprising a battery and a digital oscillator contained in a hollow ball or shell. In another form the invention comprises a linear series of LED's on a strip which can be fastened between the laces and tongue of a shoe. The current invention is different from this because EL lights are portable, attached to the current invention by a sleeved or hook on the back of them or other means, and the current invention provides for the use of retroreflective material or reflectors, U.S. Pat. No. 5,577,828 is an article of wearing apparel which uses at least one light emitting element which causes a decorative pattern to be formed. Upon further examination of the decorative described are, the light emitting element is designed to fasten to a shoe. It does not resemble the current invention because in a device for decorating a show, and does not provide for the use of retrreflective materials or reflectors.

U.S. Pat. No. 5,540,945 is a soft light strip detachably engaged with a transparent upper strip thus together constituting a sheath and a soft light-emitting device received in the sheath, upon examination of the art which pictures a vest with a long strip of light attached across the front, it did not resemble the current invention in design and use.

U.S. Pat. No. 5,688,038 is a protective device made up os padding material arranged to include an EL strip and power pack in addition to cushioning the wearer upon impact. It was presented on the shin or calf of a person's leg, knee, or elbow. The current invention does not resemble U.S. Pat. No. 5,608,038 because it is not designed to cushion a person upon impact, and also the current invention provides for the use of retroreflective materials, or reflectors.

This invention relates generally to the application and use of EL electra-luminescent lights and reflectors and retroreflective sheeting material. This invention was created in response to shortcomings in the attachment means of EL lights, reflectors, and retroreflective sheeting material to objects, persons, or animals, which has limited the use of these safety items by the general public. The EL lights are generally designed with a sleeve on their back surface that is similar to it hook, and the sleeve or hook is designed to attach to thin items, such as a belt, a shirt or any item that can accommodate the size restrictions of the sleeve or hook. This invention was created to eliminate the problems associated with the application and use of safety devices, specifically EL lights, reflectors, and retroreflective sheeting material, and thus facilitate their use.

BRIEF SUMMARY OF THE INVENTION

The present invention provides an illuminating assembly device, specifically a universal mount assembly, to attach to an object or person, to enhance visibility, recognition, and safety in hazardous situations for the user of the illuminating assembly device. The universal mount assembly device may be easily worn and removed at the user's option. The universal mount assembly device may have one or more EL lights attached to it, and may also have retroreflective or reflective sheeting material attached tb it an well. The universal mount assembly device may have one or more rigid reflectors attached to it. It is call a universal mount because it has a variety of applications it may be used for, and the universal mount assembly is designed to be detachably affixed to a wide variety of objects, people, or animals. When retroreflective sheeting is used the retroreflective sheeting material reflects incident light that is independent of the electra-luminescence of the EL light(s). The EL lights are operated by an internal battery, and are controlled by a small on/off/function switch that may be on the back surface of the EL light. It is easy to control (to turn the light switch on or off) when the EL light is secured to the universal mount assembly device. The EL lights are available in a wide variety of shapes and colors, and are produced by more than three manufacturers. Almost any of the EL lights can be adapted to attached on to the universal mount assembly device, using the hook or sleeve which may be on their back surface or additionally with the use of other means of securement when necessary. There are several manufacturers of the reflectors, reflective materials, and retroreflective sheeting material that provide a wide variety of colors, sizes, and shapes that can be attached to the universal mount assembly device.

The universal mount assembly device is comprised of a substantially flexible material to allow easy application in attaching or detaching it to an object or person or animal. It has a front surface member, a back surface member, and an inside. The front surface member has one or more openings or slots, or other means of securement for the EL light(s). The sleeve or hook on the back surface of an EL light will fit into the openings or slots an the universal mount assembly device, or additional securement means will be used whenever necessary for a secure fit of the EL light to the universal mount assembly device. The universal mount assembly device may be constructed using on or more pieces of material that fold together and are fastened together by detachable means, or are stitched or glued together to join them. In some applications the universal mount assembly device requires additional straps, or other means, for attaching the universal mount assembly device to the object, person, or animal. These straps are located at the top and the bottom areas of the universal mount assembly device, and dimensional and arranged openings or slots may be provided for a secure attachment of said straps to the universal mount assembly device. In addition, optionally, one or more sections of elastic material may be stitched to the universal mount assembly device in order to facilitate the application of a snug fit of the universal mount assembly device to the object, person, or animal. The universal mount assembly device is not limited by one method of attaching it to an object, and may use various means to accomplish the method of attachment.

Increased need for safety and visibility in hazardous situations, and to promote safety is the goal of the invention.

BRIEF DESCRIPTION OF THE SEVERAL VIEWS OF THE DRAWING

FIG. 1 illustrates the top surface of the flexible material of the mount, shown in the opened position where it is lying flat on a table, and a slot or opening is shown in the mount.

FIG. 2 illustrates the reverse surface of the mount, when it is flipped over, and upon the reverse surface we are shown hook and loop attached in predetermined locations, and also a slot or opening is shown in the mount.

DETAILED DESCRIPTION OF THE SEVERAL VIEWS OF THE DRAWING

Figure 3:
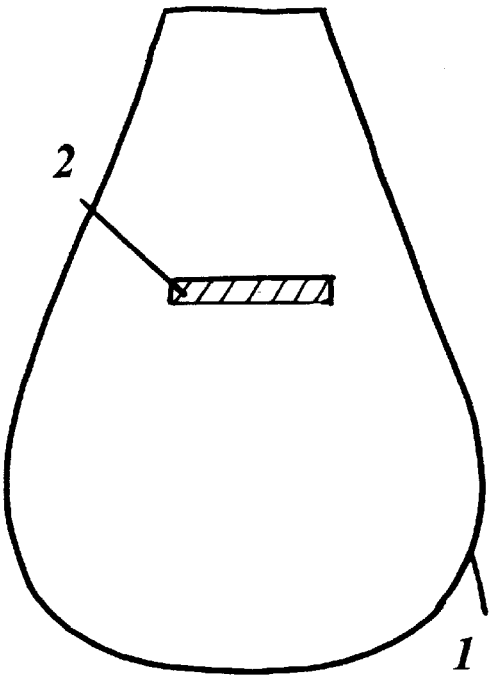
FIG. 3 illustrates the mount having been folded over to join reverse surface hook to reverse surface loop, and shown is a slot or opening is in the mount which may be used to attach an electroluminescent light to the mount.

FIG. 1 illustrates the universal mount assembly device 1, in the opened position, where we are shown a slot or opening 2 which is in the universal mount assembly device 1 for engaging with an electroluminescent light, and we see a midpoint 3 of the universal mount assembly device 1 showing the location where folding the universal mount assembly device 1 will occur. Additionally the midpoint 3 would be the location which could be severed in the event that a section of elastic is used. The elastic section would be attached to each of the severed ends and reconnect the universal mount device into one unit.

FIG. 2 illustrates the reverse surface of the turned over universal mount assembly device 1 which is shown with a slot or opening 2 which is in the universal mount assembly device 1 for engaging with an electroluminescent light, also shown is the midpoint 3 for folding the universal mount assembly device 1, aid loop 4 is attached to the universal mount assembly device 1, and hook 5 is shown attached to the universal mount assembly device 1.

FIG. 3 illustrates the universal mount assembly device 1 which has been folded together, leaving a top surface, a back surface and inside surface, and a slot or opening 2 is shown in the universal mount assembly device 1 for engaging an electroluminescent light.

Figure 4:
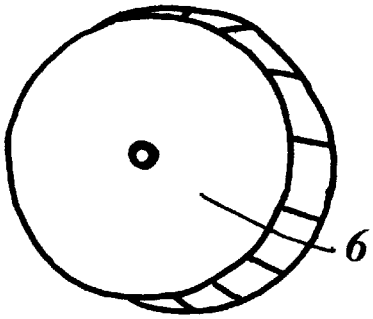
FIG. 4 gives an example of an electroluminescent light which will readily engage with the universal mount assembly device. Shown in FIG. 4 is a portable, injection molded electroluminescent light which runs on internal batteries, where the front surface or face of the electroluminescent light is shown. Also the reverse surface of the electroluminescent light is shown, which has a hook or clip on the reverse surface, and also the electroluminescent light's on/off switch is shown. The clip or hook will readily engage with the slot or opening in the universal mount assembly device, by slipping the hook into the slot, and thereby attach the electroluminescent light to the universal mount assembly device.

FIG. 4 illustrates an example of an electroluminescent light which will readily engage with the slot or opening 2 which is in the universal mount assembly device 1. The example shows an injection molded, portable, electroluminescent light that runs on internal batteries, where we are shown the face or front surface of the electroluminescent light 6, and the back surface of the electroluminescent light 7 which has a hook or clip, and an on/off switch.

Figure 5:
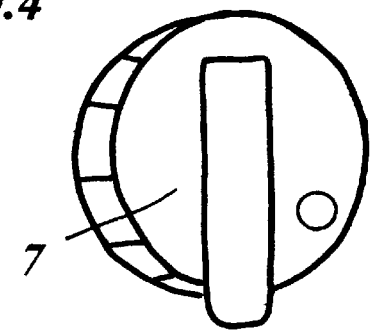
FIG. 5 illustrates a horse bridle which has a universal mount assembly device attached to the center of the browband strap on the bridle, which will place the universal mount assembly device upon the forehead of a horse. The slot or opening is shown which will engage an electroluminescent light to the universal mount assembly device.
Figure 5:
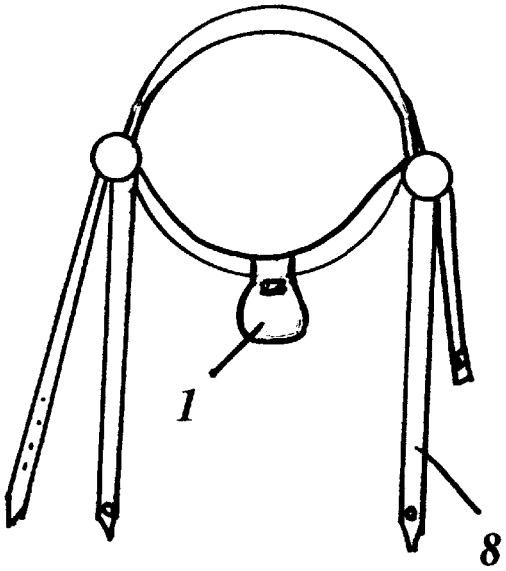

FIG. 5 illustrates a horse bridle 8 which has a browband strap, and the universal mount assembly device 1 is attached to the browband strap.

Figure 6:
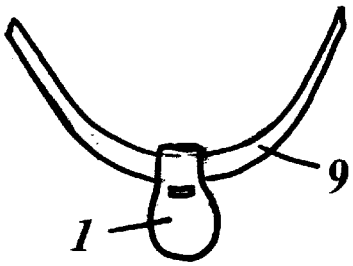
FIG. 6 illustrates an elongated strap with a universal mount assembly device attached, and the strap may attach to another object. The slot or opening is shown in the universal mount assembly device which will engage with an electroluminescent light.

FIG. 6 illustrates an elongated strap 9 to attach to another object, upon which is attached a universal mount assembly device 1.

Figure 7:
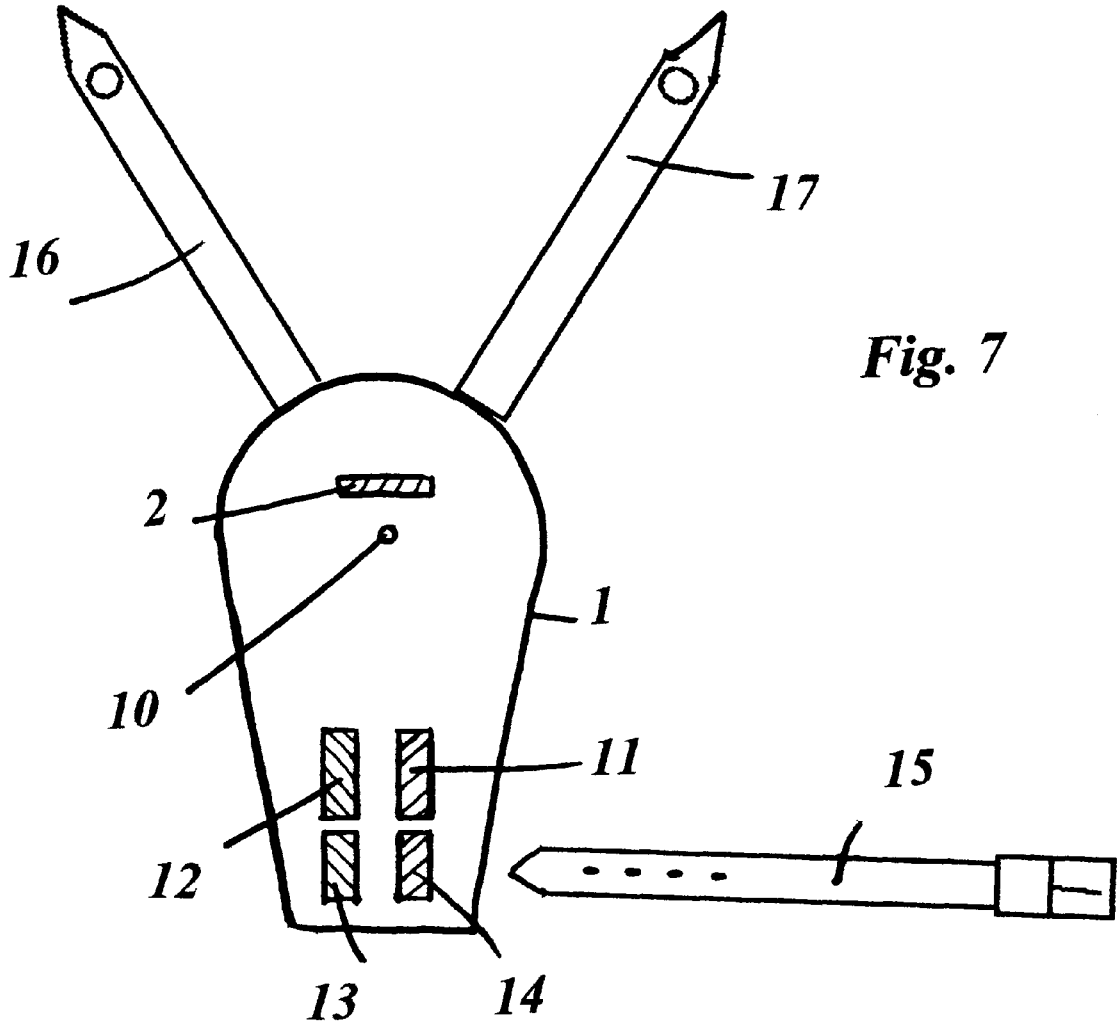
FIG. 7 illustrates the universal mount assembly device with a plurality of attachment straps shown for attaching the assembly to an object, and additional slots or openings are in the universal mount assembly device for use with the straps. Also we are shown a slot or opening in the universal mount assembly device for engaging an electroluminescent light.

FIG. 7 illustrates the universal mount assembly device 1, upon which is attached a strap with a snap at the end 16, and a strap with a snap at the end 17, a slot or opening 2 for engaging an electroluminescent light to the universal mount assembly device 1, a circular hole 10 in the universal mount assembly device 1 for attaching a rigid reflector, a slot or opening 11 and a parallel slot or opening 12, a slot or opening 13, and a slot or opening 14, and a strap with holes at one end and a buckle at the opposite end 15, which will slip into a slot or opening 13 and a slot or opening 14, and fasten together.

Figure 8:
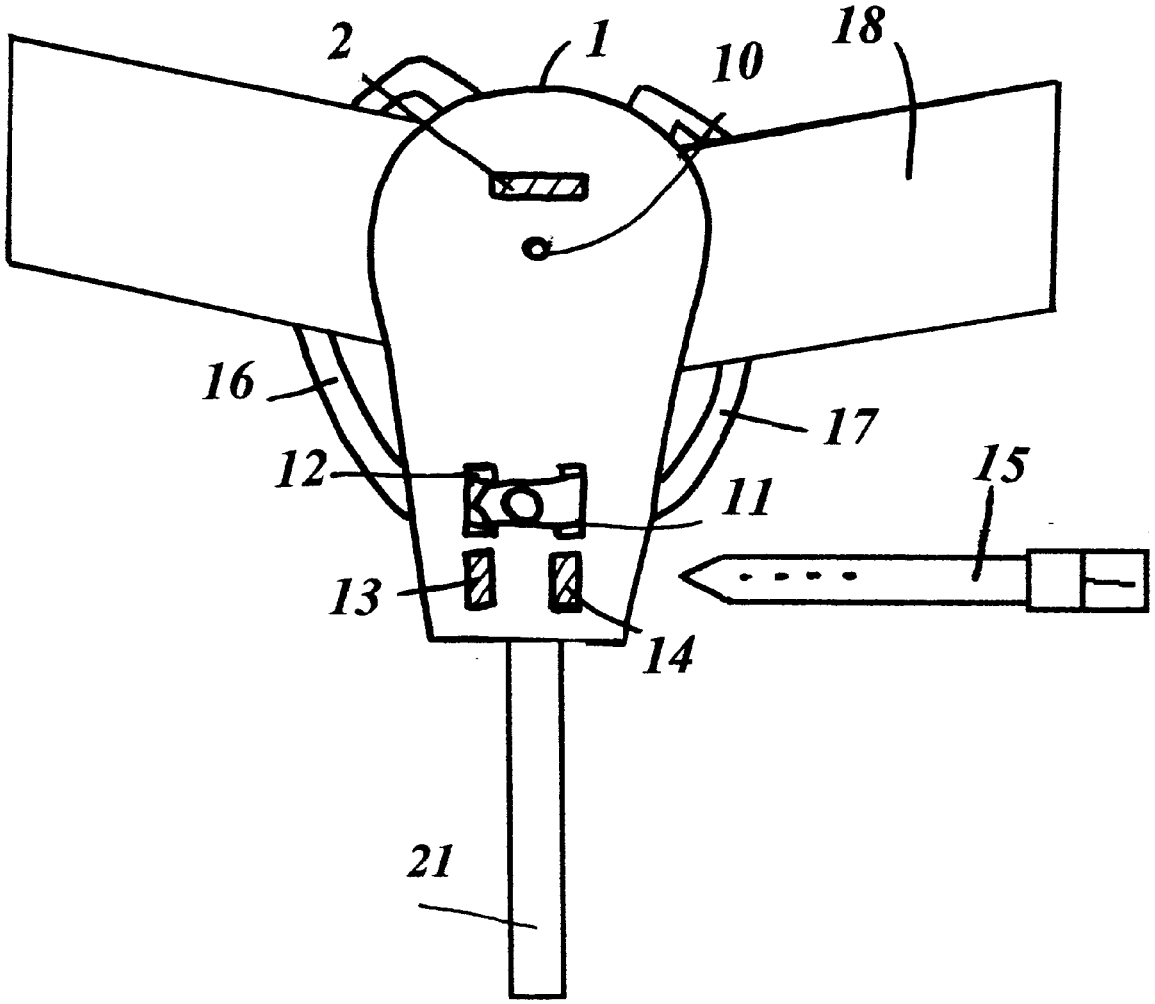
FIG. 8 illustrates the universal mount assembly device attached to a breast-collar for a horse. Two straps, which are attached to the universal mount assembly device, encircle the breast collar, are slipped into two separate slots, and are fastened together. Another strap will slip into one unused slot, encircle a breast-collar strap which fastens to the horse's cinch, come out through an unused slot and fasten together. Also shown is a slot or opening for attaching an electroluminescent light, and a circular hole in the universal mount assembly device is shown for attaching a rigid reflector.

In FIG. 8 illustrates a horse breast-collar 18 with the universal mount assembly device 1 attached, by encircling the breast-collar 18 and slipping a strap with a snap on the end 16 into a slot 12 in the universal mount assembly device 1, and also encircling the breast-collar and slipping a strap with a snap on the end 17 through a slot 11 in the universal mount assembly device 1, and joining a strap with a snap on the end 16 to a strap with a snap on the end 17, together. Also shown is a strap with a buckle at one end and holes at the opposite end 15 which will slip into a slot 14 in the universal mount assembly device, encircle another strap of the breast-collar 18, and come out through a slot 13 in the universal mount assembly device 1, and then be fastened together. Also shown is a slot or opening 2 in the universal mount assembly device 1 for engaging an electroluminescent light, and a circular hole 10 is shown which is used to attach a rigid reflector to the universal mount assembly device 1.

Figure 9:
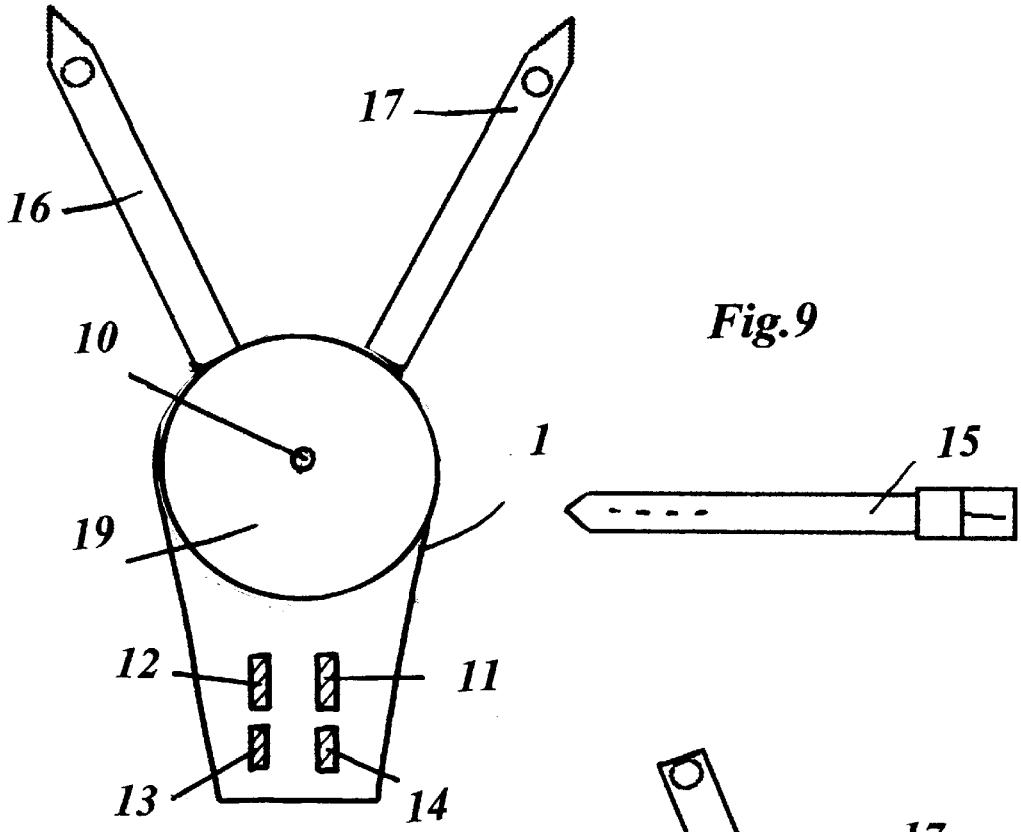
FIG. 9 illustrates the universal mount assembly device which has a plurality of straps for attaching the universal mount assembly to an object, slots or openings in the universal mount assembly device which the straps will slip into, and a rigid reflector is mounted upon the top surface of the universal mount assembly device.

FIG. 9 illustrates the universal mount assembly device 1 attached with a strap with a snap at one end 16 and a strap with a snap at one end 17, both used for attaching the universal mount assembly device 1 to an object, a circular hole 10 in the universal mount assembly device used for attaching a rigid reflector 19 by using a nut and bolt inserted into the circular hole 10 in the universal mount assembly device. Also shown in FIG. 9 is the universal mount assembly device 1 with a slot or opening 11, a slot or opening 12, a slot or opening 13, and a slot or opening 14. Also shown is a strap with a buckle at one end and holes in the opposite end 15 which will also be used to attach the universal mount assembly device 1 to an object.

Figure 10:
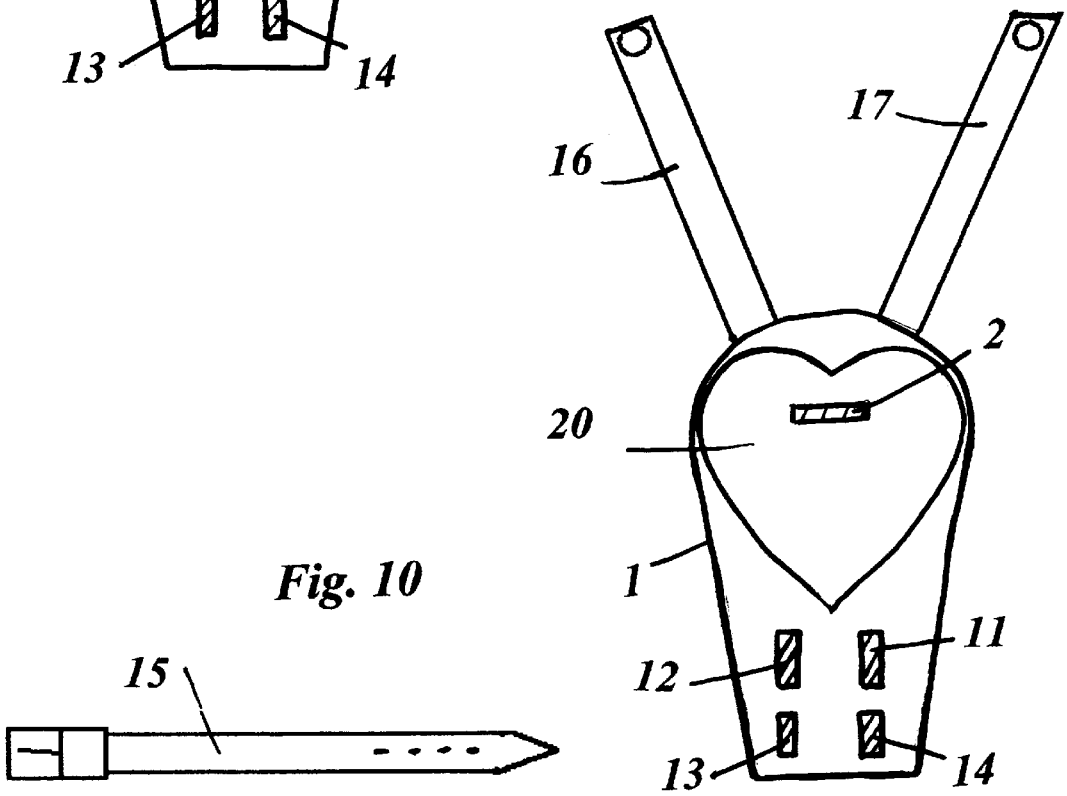
FIG. 10 illustrates the universal mount assembly device which has a plurality of straps shown which are used to attach the universal mount assembly device to another object, slots or openings which the straps will slip into, and retroreflective materials are upon the top surface of the universal mount assembly device cut in the shape of a heart. The retroreflective material as shown has a slot or opening in it, for engaging with an electrolumenescent light.

FIG. 10 illustrates the universal mount assembly device 1 which shows attached a strap with a snap at one end 16, a strap

I claim:

1. An illuminated universal mount device comprising:

a sheet of substantially flexible material, having a predetermined shape and first and second surfaces;

said sheet folded and secured together so that the second surfaces contact each other thus creating a pocket having opposing inside surfaces and an outside surface; said outside surface having a front and back surface;

an opening or slot formed in said front surface;

said slot securing a detachable electroluminescent light source;

a sheet of substantially flexible retroreflective material, having a predetermined shape and first and second surfaces;

said sheet secured to said front surface of the universal mount by using means of attachment;

whereby the mount device is detachably secured to a strap worn by an animal.

2. The mount device as claimed in claim 1 wherein said strap that the device is attached to, is worn by a horse.

3. The mount device as claimed in claim 1 further including a plurality of flexible straps for attaching the device to different objects.

4. The mount device an claimed in claim 1 further including a plurality of attached predetermined straps, and a plurality of slots in the mount device;

whereby attaching the device to an object is facilitated.

5. The mount device as claimed in claim 1 further including at least one opening in the retroreflective material for attaching said electroluminescent light.

6. The mount device as claimed in claim 1 further including a plurality of slots for receiving a plurality of light sources.

7. An assembled universal mount device comprising:

a sheet of substantially flexible material, having a predetermined shape and first and second surfaces;

folding and securing together said material so that the second surfaces contact each other thus creating a pocket having opposing inside surfaces and an outside surface; said outside surface having a front and back surface;

cutting an opening or slot in said front surface;

attaching an electroluminescent light source facing outwardly to said slot using a means of attachment;

whereby the mount device is subsequently secured to a strap worn by an animal.

8. A mount device as claimed in claim 7 wherein said strap on said animal is a horse headstall strap.

9. A mount device as claimed in claim 7 wherein said light source has a clip or hook upon the reverse surface which will slip into, and thereby engage with, said slot in said mount device.

10. The mount device as claimed in claim 7 further including a plurality of slots for receiving a plurality of light sources.

11. A mount device as claimed in claim 7 further including splitting said mount device into two parts at a midpoint;

attaching a section of elastic to the severed ends of the device rejoining the mount device into one connected unit;

whereby attaching the universal mount device to an object is improved by the gripping action of the elastic.

12. The mount device as claimed in claim 7 further including cutting at least one opening in said device, said opening used for connecting a rigid reflector to said mount device by using a means of attachment.

* * * * *